US009017116B2

(12) United States Patent
Ando et al.

(10) Patent No.: US 9,017,116 B2
(45) Date of Patent: Apr. 28, 2015

(54) FEMALE TERMINAL

(71) Applicant: Yazaki Corporation, Tokyo (JP)

(72) Inventors: Shuhei Ando, Kakegawa (JP); Terumichi Matsumoto, Kakegawa (JP); Hajime Kato, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 3 days.

(21) Appl. No.: 14/108,852

(22) Filed: Dec. 17, 2013

(65) Prior Publication Data

US 2014/0170912 A1 Jun. 19, 2014

Related U.S. Application Data

(63) Continuation of application No. PCT/JP2012/003767, filed on Jun. 8, 2012.

(30) Foreign Application Priority Data

Jun. 21, 2011 (JP) ..... 2011-137169

(51) Int. Cl.
*H01R 13/11* (2006.01)
*H01R 13/187* (2006.01)
*H01R 13/24* (2006.01)

(52) U.S. Cl.
CPC ..... *H01R 13/113* (2013.01); *H01R 13/187* (2013.01); *H01R 13/2442* (2013.01); *H01R 13/2457* (2013.01)

(58) Field of Classification Search
CPC .... H01R 13/113; H01R 13/11; H01R 13/111; H01R 43/16
See application file for complete search history.

(56) References Cited

U.S. PATENT DOCUMENTS 5,269,712 A 12/1993 Denlinger et al.
6,264,509 B1 7/2001 Kwang et al.
7,175,487 B2 * 2/2007 Urbaniak et al. ..... 439/852
7,252,562 B1 * 8/2007 Chen et al. ..... 439/852

(Continued)

FOREIGN PATENT DOCUMENTS

DE 102 44 946 A1 4/2003
DE 20 2004 006 433 U1 9/2004

(Continued)

OTHER PUBLICATIONS

International Search Report issued by the European Patent Office in corresponding International Application No. PCT/JP2012/003767, mailed Oct. 5, 2012 (3 pages).

(Continued)

*Primary Examiner* — Gary Paumen
(74) *Attorney, Agent, or Firm* — Sughrue Mion, PLLC

(57) ABSTRACT

An electrical connector for a male terminal to be inserted includes an elastic contact member provided in at least one of surfaces of the electrical connector extending in an insertion direction of the male terminal. The elastic contact member is configured to get into contact with the male terminal. The elastic contact member includes: first elastic contact pieces formed with a space in between in a widthwise direction orthogonal to the insertion direction, cantilevered at one end side of the at least one surface in the insertion direction, and configured to get into contact with the male terminal inserted in the electrical connector; and a second elastic contact piece disposed in the space and configured to get into contact with the male terminal inserted in the electrical connector.

4 Claims, 5 Drawing Sheets

(56) References Cited

U.S. PATENT DOCUMENTS

| | | | | |
|---|---|---|---|---|
| 7,553,203 | B2 * | 6/2009 | Anbo et al. | 439/852 |
| 2006/0141873 | A1 * | 6/2006 | Casses et al. | 439/852 |
| 2007/0161300 | A1 * | 7/2007 | Ishigami | 439/851 |
| 2008/0070452 | A1 * | 3/2008 | Komiyama et al. | 439/852 |
| 2009/0253315 | A1 * | 10/2009 | Busies et al. | 439/884 |
| 2010/0216354 | A1 | 8/2010 | Copper et al. | |
| 2011/0045712 | A1 | 2/2011 | Mukuno | |
| 2013/0244504 | A1 * | 9/2013 | Ogura | 439/759 |

FOREIGN PATENT DOCUMENTS

| | | | |
|---|---|---|---|
| DE | 10 2005 033 696 | A1 | 3/2006 |
| DE | 10 2006 001 102 | A1 | 7/2007 |
| EP | 1 420 481 | A1 | 5/2004 |
| JP | 10503319 | A | 3/1998 |
| JP | 2002-100430 | A | 4/2002 |
| JP | 2005166300 | A | 6/2005 |
| JP | 2011-044256 | A | 3/2011 |
| JP | 2011086540 | A | 4/2011 |

OTHER PUBLICATIONS

Written Opinion of the International Searching Authority issued by the European Patent Office in corresponding International Application No. PCT/JP2012/003767, mailed Oct. 5, 2012.

Communication dated Jan. 6, 2015 from the Japanese Patent Office in counterpart application No. 2011-137169.

* cited by examiner

FEMALE TERMINAL

CROSS REFERENCE TO RELATED APPLICATION

This application is a Continuation of PCT Application No. PCT/JP2012/003767, filed on Jun. 8, 2012, and claims the priority of Japanese Patent Application. No. 2011-137169, filed on Jun. 21, 2011, the content of both of which is incorporated herein by reference.

BACKGROUND

1. Technical Field

The present invention relates to a female terminal: including an electrical connector into which a male terminal is to be inserted; and configured to be electrically connected to the male terminal inserted in the electrical connector.

2. Related Art

Japanese Unexamined Patent Application Publication No. 2002-100430 and Japanese Unexamined Patent Application Publication No. 2011-44256 describe female terminals to be electrically connected to their respective male terminals.

Such female terminals each, mainly include an electrical connector into which the male terminal is to be inserted; elastic contact members built in the electrical connector, and being capable of getting into contact with the male terminal; and an electrical wire crimp part to be crimped onto an electrical wire electrically connected to the male terminal inserted in the electrical connector.

Once the male terminal is inserted into the electrical connecter in which the elastic contact members are arranged, the elastically-deformed elastic contact pieces of the elastic contact members get into pressure contact with the male terminal due to resilience. Thereby, the female terminal is electrically connected to the male terminal. In addition, multiple elastic contact pieces are provided to each elastic contact member for the purpose of increasing the area of the contact between the elastic contact member and the male terminal.

SUMMARY

As a process of forming multiple elastic contact pieces in each elastic contact, member, a process is sometimes used in which: slits with an appropriate shape are formed in the base material of the elastic contact member by punching; and the elastic contact pieces are formed between the slits.

When such punching is carried out, it is desirable that, the width of each slit have a dimension greater than the thickness of the base material of the elastic contact member to extend the life of the die. In exchange for making the width of the slit, greater, the number of elastic contact pieces formable in the base material of the elastic contact member decreases naturally.

As described above, it is desirable to form more elastic contact pieces in the elastic contact member in order to increase the area of the contact between the elastic contact member and the male terminal, whereas it is important to design the elastic contact member to include fewer elastic contact pieces in order to extend the life of the die used for the process.

An object of the present invention is to provide a female terminal which enables more elastic contact pieces than ever to be formed in each elastic contact member without sacrificing the life of the die used for the process.

An aspect of the present invention is a female terminal including: an electrical connector for a male terminal to be inserted; an electrical wire connector formed integrally with the electrical connector and connected to an electrical wire to be electrically connected to the male terminal inserted in the electrical connector. The electrical connector includes an elastic contact member provided in at least one of surfaces of the electrical connector extending in an insertion direction of the male terminal. The elastic contact member is configured to get into contact with the male terminal. The elastic contact member includes first elastic contact pieces formed with a space in between in a widthwise direction orthogonal to the insertion direction, are cantilevered at one end side of the at least one surface in the insertion direction, and are configured to get into contact with the male terminal inserted in the electrical connector. The elastic contact member includes a second elastic contact piece disposed in the space and configured to get into contact with the male terminal inserted in the electrical connector.

In the foregoing aspect, the electrical connector in which the elastic contact member is formed is formed integrally with the electrical wire connector. For this reason, it is possible to reduce the value of the resistance between the elastic contact member and the electrical connector, and accordingly to curb heat generation attributable to am otherwise increase in the value of the resistance.

Because one of the second elastic contact pieces is disposed in the space between the first elastic contact pieces, the number of elastic contact pieces formable in the elastic contact member can be increased even if the space between the first elastic contact pieces and the space between the second elastic contact pieces are made wider. For this reason, more elastic contact pieces than ever can be formed in the elastic contact member without sacrificing the life of the die used to punch portions from the elastic contact member to form the space between the first elastic contact pieces and the space between the second elastic contact pieces.

For this reason, it is possible to efficiently form a large number of elastic contact pieces in the elastic contact member, and accordingly to form a small elastic contact member which secures a larger cross-sectional area for current flow, and has a low resistance value.

The first elastic contact pieces and the second elastic contact piece may be formed integrally with the at least one surface, and the second elastic contact piece may be disposed in the space by being folded back at an other end side of the at least one surface in the insertion direction.

In the foregoing configuration, the first elastic contact pieces and the second elastic contact piece are formed in the same surface of the electrical connector. In addition, the first elastic contact pieces and the second elastic contact piece are formed at positions shifted from, each other in the direction in which the first elastic contact pieces are arranged with the space in between. With this structure, in a bending process of the first elastic contact pieces and the second elastic contact piece, the second elastic: contact, piece can be easily disposed, between the first elastic contact pieces.

The female terminal may include elastic contact members respectively formed in two opposed surfaces of the electrical connector. The elastic contact members formed in the two surfaces may hold the male terminal therebetween.

The foregoing configuration, makes it possible to enhance the reliability of the electrical connection between the electrical connector and the male terminal, because the male terminal is held between and by the elastic contact members of the respective two surfaces of the electrical connector.

The first elastic contact pieces may respectively include first contact portions configured to get into contact with the male terminal inserted in the electrical connector. The second elastic contact piece may include a second contact portion configured to get into contact with the male terminal inserted in the electrical connector. The first contact portions and the second contact portion may be arranged at positions shifted from each other in the insertion direction.

The foregoing configuration makes it possible for the male terminal to receive insertion resistance from the first elastic contact pieces and insertion resistance from the second elastic contact piece separately, unlike a configuration in which the contact portions of all the elastic contact pieces are arranged in a line at the same positions in the insertion direction of the male terminal.

For this reason, the male terminal can be inserted into the electrical connector with smaller insertion force. This makes it possible to enhance the workability, and to prevent the male terminal from being insufficiently fitted into the female terminal due to insufficient insertion of the male terminal into the female terminal.

DETAILED DESCRIPTION

Figure 1:
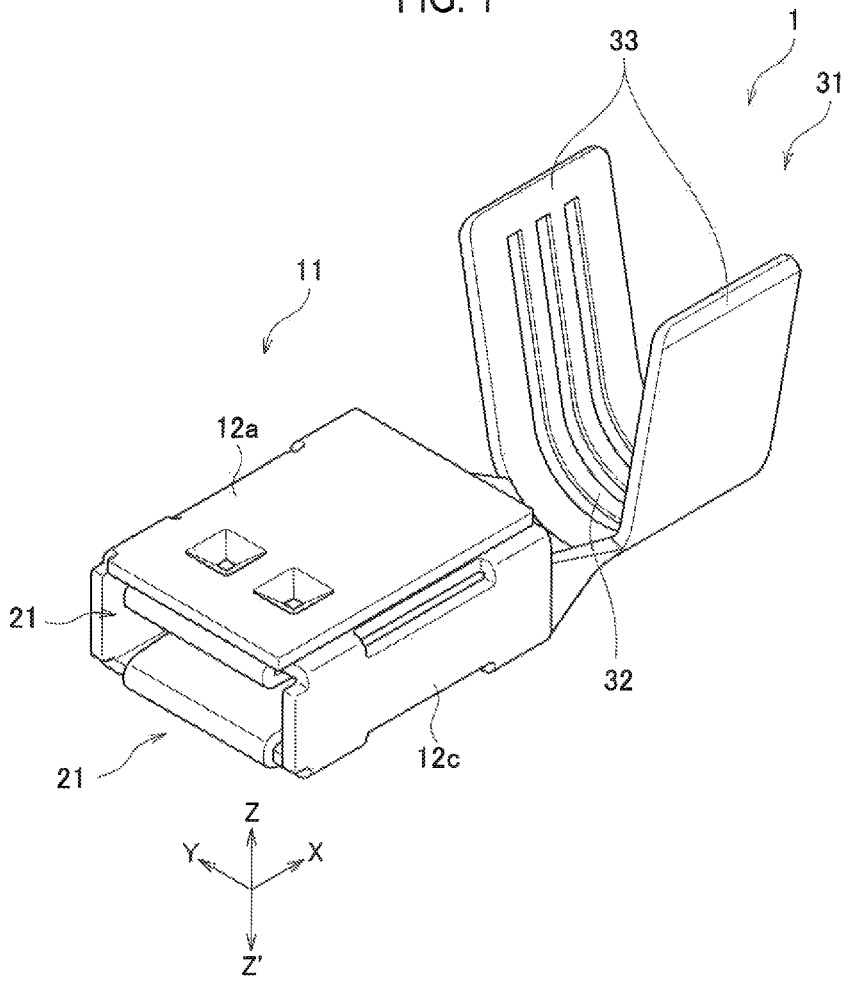
FIG. 1 is a perspective view showing a female terminal according to an embodiment of the present invention.

Descriptions will be hereinbelow provided for a female terminal 1 of an embodiment of the present invention by referring to the drawings. To begin with, detailed descriptions will be provided for a configuration of the female terminal 1 of the embodiment of the present invention by referring to FIG. 1 and FIGS. 2A-2C.

Figure 2A:
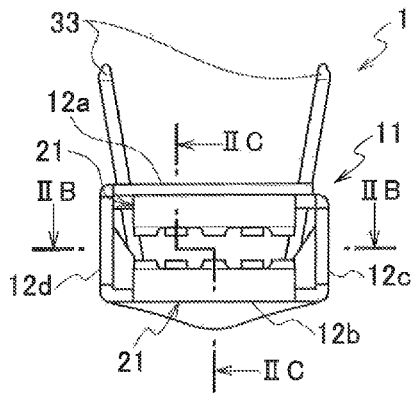
FIG. 2A is a plan view of the female terminal according to the embodiment of the present invention.
Figure 2B:
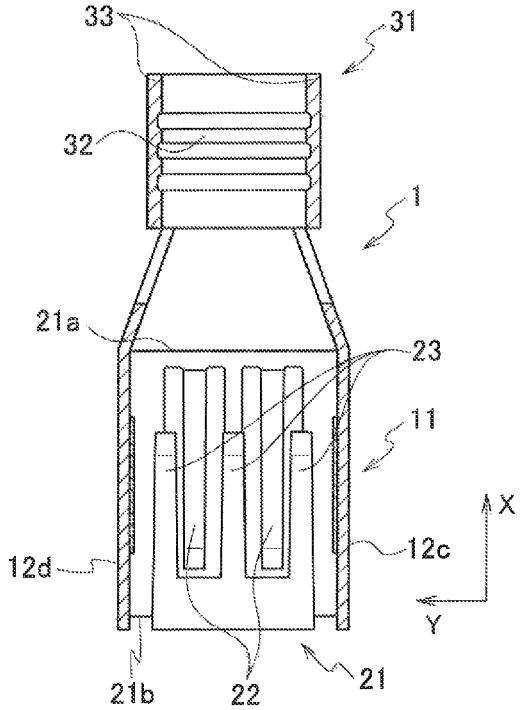
FIG. 2B is a cross-sectional view of the female terminal taken along the line IIB-IIB of FIG. 2A.
Figure 2C:
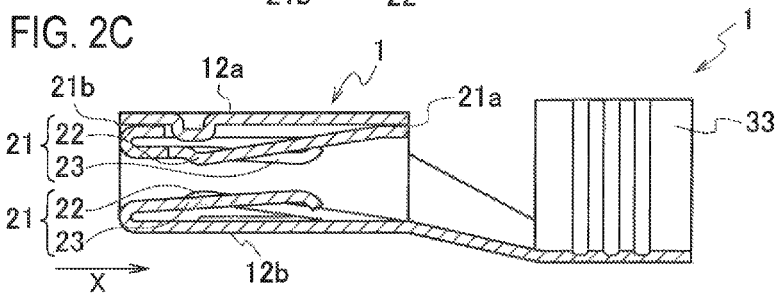
FIG. 2C is a cross-sectional view of the female terminal taken along the line IIC-IIC of FIG. 2A.

FIG. 1 is a perspective view showing; the female terminal 1 of the embodiment of the present invention. FIG. 2A is a plan view showing the female terminal 1 of the embodiment of the present invention. FIG. 2B is a cross-sectional view of the female terminal 1 taken along the IIB-IIB line of FIG. 2A. FIG. 2C is a cross-sectional view of the female terminal 1 taken along the IIC-IIC line of FIG. 2A.

The female terminal 1 of the embodiment of the present invention is electrically connected to a male terminal while holding a high-voltage electrical wire in use for an electrical system of a vehicle and the like.

As shown in FIG. 1 and FIGS. 2A-2C, the female terminal 1 of the embodiment of the present invention includes, among other things, an electrical connector 11 into which a male terminal (unillustrated) is to be inserted; and an electrical wire crimp part 31 to which an electrical wire (unillustrated) electrically connected to the male terminal inserted in the electrical connector 11 is to be connected by crimping. The electrical wire crimp part 31 may be replaced with an electrical connector to which the electrical wire is to be connected by welding or the like, other than by crimping.

As shown in FIG. 2A, the electrical connector 11 is shaped like a rectangular box surrounded by surfaces (a top surface 12*a*, a bottom surface 12*b* and lateral surfaces 12*c*, 12*d*) extending in an insertion direction of the male terminal (unillustrated) to be inserted into the electrical connector 11 (an arrow-X direction in FIG. 1).

As shown in FIGS. 2A and 2C, elastic contact members 21 which are elastic and capable of getting into contact with the male terminal (unillustrated) inserted in the electrical connector 11 are formed, respectively, in the top surface 12*a* and the bottom surface 12*b* of the electrical connector 11.

As shown in FIG. 2B and FIG. 2C, two first elastic contact pieces 22 and three second elastic contact pieces 23 are formed in each of the elastic contact members 21 formed respectively in the top surface 12*a* and the bottom surface 12*b* of the electrical connector 11. Detailed descriptions will be provided for the first elastic contact pieces 22 and the second elastic contact pieces 23 later.

Once the male terminal (unillustrated) is inserted into the electrical connector 11, the elastic contact member 21 (the first elastic contact pieces 22 and the second elastic contact pieces 23) formed in the top surface 12*a* deforms elastically in an arrow-Z direction in FIG. 1, and gets into contact with the male terminal due to the resilience.

On the other hand, once the male terminal (unillustrated) is inserted, into the electrical connector 11, the elastic contact member 21 (the first elastic contact pieces 22 and the second elastic contact pieces 23) formed in the bottom surface 12*b* deforms elastically in an arrow-Z' direction in FIG. 1, and gets into contact with the male terminal due to the resilience.

As shown, in FIG. 1 and FIG. 2C, the elastic contact members 21 are formed integrally with the electrical connector 11 formed in the above-described way. The electrical connector 11 with which the elastic contact members 21 are integrally formed is formed integrally with the electrical wire crimp part 31.

As described above, the electrical connector 11 with which the elastic contact members 21 are integrally formed is formed integrally with the electrical wire crimp part 31. This makes it possible to reduce a value of the resistance between each elastic contact member 21 and the electrical connector 11, and accordingly to curb the heat generation attributable to an otherwise increase in the value of resistance.

Because the elastic contact members 21 are formed integrally with the electrical connector 11 and the electrical wire crimp part 31, it is possible to reduce the number of parts of the female terminal 1, and thereby to reduce the manufacturing costs.

As shown in FIG. 1, a bottom wall 32 and squeeze pieces 33 are formed in the electrical wire crimp part 31. The core wire of the electrical wire (unillustrated) is positioned to the bottom wall 32. The squeeze pieces 33 are provided by being bent upward from the bottom wall 32. The squeeze pieces 33 are squeezed around the electrically-conductive body and cover of the electrical wire.

The electrical, wire (unillustrated) is fixed to the bottom wall 32 by bending and squeezing the squeeze pieces 33 so as to wrap the electrical wire positioned to the bottom wall 32.

As shown in FIGS. 2A and 2C, once the male terminal (unillustrated) is inserted into the electrical connector 11, the female terminal 1 formed in the above-described way holds the male terminal between the elastic contact members 21 which are formed, in the respective two opposed surfaces (the top surface 12*a* and the bottom surface 12*b*, see FIG. 2A and FIG. 2C).

Because, as described above, the male terminal is held between and by the elastic contact members 21 formed in the respective two surfaces (the top surface 12*a* and the bottom surface 12*b*, see FIG. 2A and FIG. 2C), the female terminal 1 (see FIG. 1) can enhance the reliability of the electrical connection between the female terminal 1 and the male terminal (unillustrated).

Figure 3:
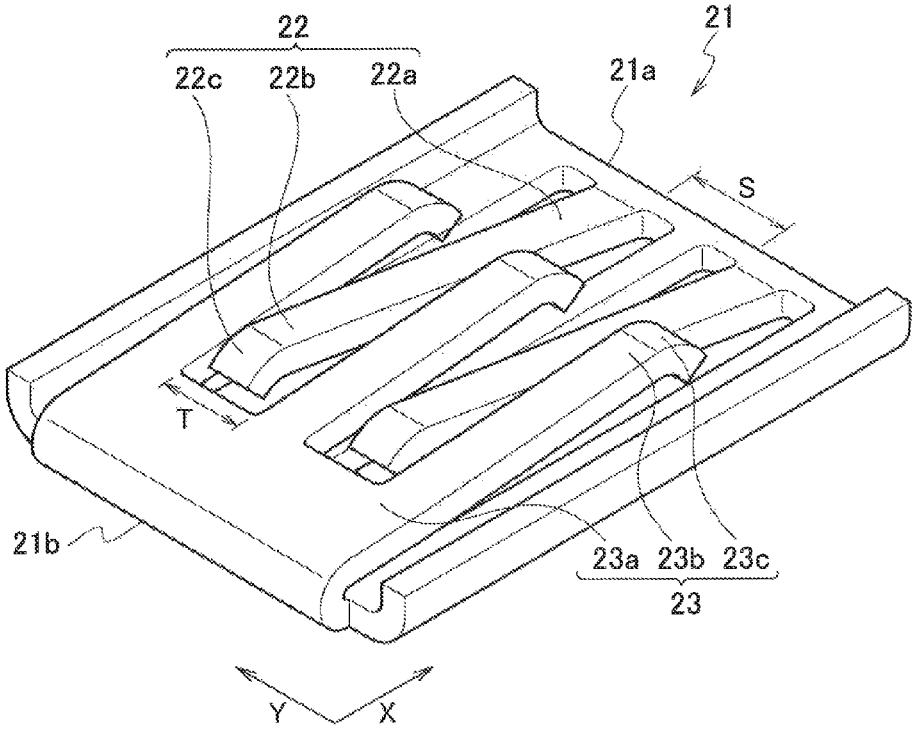
FIG. 3 is a perspective view showing an elastic contact member of the female terminal, according to the embodiment of the present invention.

Next, detailed descriptions will be provided for a configuration of the elastic contact members 21 of the embodiment of the present invention by referring to FIG. 3. FIG. 3 is a perspective view showing one elastic contact member 21 of the female terminal 1 of the embodiment of the present invention.

As described above, the two first elastic contact pieces 22 and the three second elastic contact pieces 23 are formed in each of the elastic contact members 21 which are formed, respectively, in the top surface 12*a* and the bottom surface 12*b* of the electrical connector 11 (see FIG. 2B and FIG. 2C).

As shown in FIG. 3, the multiple first elastic contact pieces 22 are formed with a space S in between in a widthwise direction (an arrow-Y direction in FIG. 3) orthogonal to the insertion, direction of the male terminal (unillustrated) to be inserted into the electrical connector 11 (a arrow-X direction in FIG. 3).

Each first elastic contact piece 22 includes: a cantilevered portion 22*a*, which is cantilevered at a first end 21*a* side of the top surface 12*a* or the bottom surface 12*b* of the electrical connector 11 (see FIG. 2C) in the insertion direction of the male terminal (unillustrated) (in the arrow-X direction in FIG. 3); a contact portion (first, contact portion) 22*b* designed, to get into contact with the male terminal; and a free end 22*c* not fixed to the electrical connector 11.

The free end 22*c* side of the contact portion 22*b* of each first elastic contact piece 22 projects inward from a corresponding one of the top surface 12*a* and the bottom surface 12*b* (see FIG. 20) in a way that makes the contact portion 22*b* flush with a contact portion 23*b* of each second elastic contact piece 23, which will be described later.

As shown in FIG. 3, the multiple second elastic contact pieces 23 are formed with a space T between them in the widthwise direction (the arrow-Y direction in FIG. 3) orthogonal to the insertion direction of the male terminal (unillustrated) to be inserted into the electrical connector 11 (the arrow-X direction in FIG. 3).

Each second elastic contact piece 23 includes; a cantilevered portion 23*a*, which is cantilevered at a second end 21*b* side of the top surface 12*a* or the bottom surface 12*b* of the electrical connector 11 (see FIG. 2C) in the insertion direction of the male terminal (unillustrated) (in the arrow-X direction in FIG. 3); a contact portion (second contact portion) 23*b* designed to get into contact with the male terminal; and a free end 23*c* not fixed to the electrical connector 11.

As shown in FIG. 3, the first elastic contact pieces 22 and the second elastic contact pieces 23, which are formed in the above-described way, are integrally formed with each of the top surface 12*a* and the bottom surface 12*b* of the electrical connector 11 (see FIG. 2C).

The first elastic contact pieces 22 and the second elastic contact pieces 23 are formed at positions where the first elastic contact pieces 22 are shifted from the second elastic contact pieces 2 3 in the widthwise direction (the arrow-Y direction in FIG. 3).

With this structure, when the electrical connector 11 is folded back at the second end 21*b* of each of the top surface 12*a* and the bottom surface 12*b* (see FIG. 2C), one of the second elastic contact pieces 23 can be easily disposed in the space S, and the first elastic contact pieces 22 can be easily disposed in the respective spaces T. In addition, the remaining two of the second elastic contact pieces 23 can be disposed at both sides of the first elastic contact pieces 22, respectively, with the space T from the second elastic contact piece 23 disposed in the space S.

Because, as described above, the first elastic contact pieces 22 are disposed in the respective spaces T while one of the second elastic contact pieces 23 is disposed in the space S, the first elastic contact pieces 22 and the second elastic contact pieces 23 do not interfere with each other. This makes it possible to form each first elastic contact piece 22 and each second elastic contact piece 23 with a length which is almost equal to the full length of the male terminal (unillustrated) in the insertion direction of the male terminal (in the arrow-X direction in FIG. 3 ). Accordingly, it is possible to enhance the elastic force of each first elastic contact piece 22 and the elastic force of each second elastic contact piece 23, and to reduce the insertion force with which the male terminal (unillustrated) is inserted.

Given the strength of the die for the elastic contact members 21, it is desirable that the space S between the first elastic contact pieces 22 and the space T between the second, elastic contact pieces 23 should be long enough, for the width of the die to have a certain dimension. However, if the space S between the first elastic contact pieces 22 and the space T between the second elastic contact pieces 23 are too wide, the number of elastic contact pieces formable per unit length in each, elastic contact member 21 decreases in exchange for the increase in the rigidity of the die.

However, in the female terminal 1 (see FIG. 1) of the embodiment of the present invention, as shown in FIG. 3, one of the second elastic contact pieces 23 is disposed in the space S between the first elastic contact pieces 22, while the first elastic contact, pieces 22 are disposed in the respective spaces T between the second elastic contact pieces 23. Thereby, the first elastic contact pieces 22 and the second, elastic contact pieces 23, which are formed as discrete members, are staggered.

For this reason, though the space S between the first elastic contact pieces 22 and the space T between the second elastic contact pieces 23 need to be widen to form the first and second elastic contact pieces 22, 23 from the thick elastic contact member 21 by punching with the die, the number of elastic contact pieces 22, 23 arranged per unit length in the elastic contact member 21 can be increased by effectively using the space S and the spaces T.

Because, as shown in FIG. 3, the first elastic contact pieces 22 and the second, elastic contact pieces 23 mesh with each other, the length of each of the first and second elastic contact pieces 22, 23 can be made long enough. Accordingly, the elastic force of each of the first and second elastic contact pieces 22, 23 increases, and it is possible to reduce the insertion force with which the male terminal (unillustrated) is inserted into the electrical connector 11.

Figure 4:
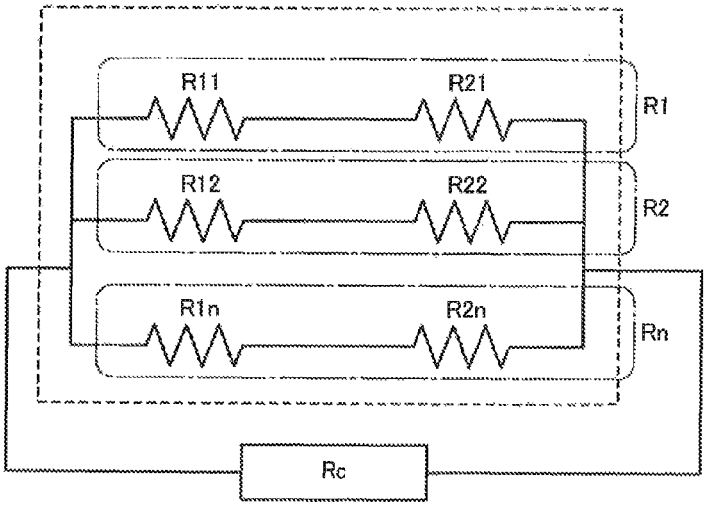
FIG. 4 is a diagram for explaining a resistance value of the female terminal according to the embodiment of the present invention.

Next, descriptions will be provided for a resistance value of the female terminal 1 of the embodiment of the present invention by referring to FIG. 4. FIG. 4 is a diagram for explaining the resistance value of the female terminal 1 of the embodiment of the present invention.

As shown in FIG. 4, the resistance of any one of the first and second elastic contact pieces 22, 23 (see FIG. 3) takes a value which is obtained by the following expression $$R1=R11+R21$$

where R1 denotes a value of the resistance of the one of the first and second elastic contact, pieces 22, 23; R11 denotes a value of the conductor resistance of the one of the first and second elastic contact pieces 22, 23 (which is expressed with the value of its material resistance multiplied by its length, and divided by its cross-sectional area); and R21 denotes a value of the contact resistance between the male terminal (unillustrated) and the one of the first and second elastic contact pieces 22, 23.

Accordingly, as shown in FIG. 4, the value Rc of the resistance of each elastic contact member 21, which includes multiple first elastic contact pieces 22 and multiple second elastic contact pieces 23, can be obtained by the following equation $$1/R1+1/R2+\ldots+1/Rn=1/Rc,$$

like a value of a resistance of a parallel circuit.

For this reason, when multiple elastic contact pieces 22 and multiple elastic contact pieces 23 are provided to each elastic contact member 21 (see FIG. 3), it is possible to reduce a value of the contact resistance between the male terminal (unillustrated) and the elastic contact member 21.

To put it specifically, in a case where the value of the contact resistance between the male terminal (unillustrated) and each elastic contact member 21 as a whole (see FIG. 3) is assumed to be 1 (one) when one elastic contact piece is provided to the elastic contact member 21, the value of the contact resistance in between is reduced to 0.1 when 10 of the first and second elastic contact pieces 22, 23 are provided to the elastic contact member 21.

Accordingly, when the number of contact points between the elastic contact member 21 (see FIG. 3 ) and the male terminal (unillustrated) is increased by providing multiple first elastic, contact pieces 22 and multiple second elastic contact pieces 23 to the elastic contact member 21 (see FIG. 3 ), it is possible to reduce the resistance of the elastic contact member 21.

When, as described above, multiple first elastic contact pieces 22 and multiple second elastic contact pieces 23 are provided, to the elastic contact member 21 (see FIG. 3), this increases the cross-sectional area of current flow in the elastic contact member 21, as well as the number of contact points between the elastic contact member 21 and the male terminal (unillustrated). This increases the number of parallel circuits in accordance with the increase in the number of first elastic contact pieces 22 and the number of second elastic contact pieces 23. For this reason, it is possible to reduce the value of the resistance of the elastic contact member 21.

The first elastic contact, pieces 22 (see FIG. 3 ) and the second elastic contact pieces 23 (see FIG. 3 ) can be increased in number while securing the cross-sectional area of current flow in the elastic contact member 21. This makes it possible to reduce the value of the resistance of the elastic contact member 21, and accordingly to produce the female terminal 1 (see FIG. 1) in a smaller size.

Let us imagine a female terminal in which multiple elastic contact pieces are provided to a unitary member which is folded back at the first end 21*a* or the second end 21*b* of the top surface 12*a* or the bottom surface 12*b* (see FIG. 2C) of the electrical connector 11. In this imaginary female terminal, the contact portions of the elastic contact pieces are arranged in a line, respectively, at the same positions in the insertion direction of the male terminal (unillustrated) (in the arrow-X direction in FIG. 3).

For this reason, when the male terminal (unillustrated) is inserted into the electrical connector 11 of the imaginary female terminal, the contact portions of the respective elastic contact pieces start to get into contact with the male terminal at the same, and the male terminal accordingly receives insertion resistances from the elastic contact pieces due to their resilience at the same time.

Figure 5:
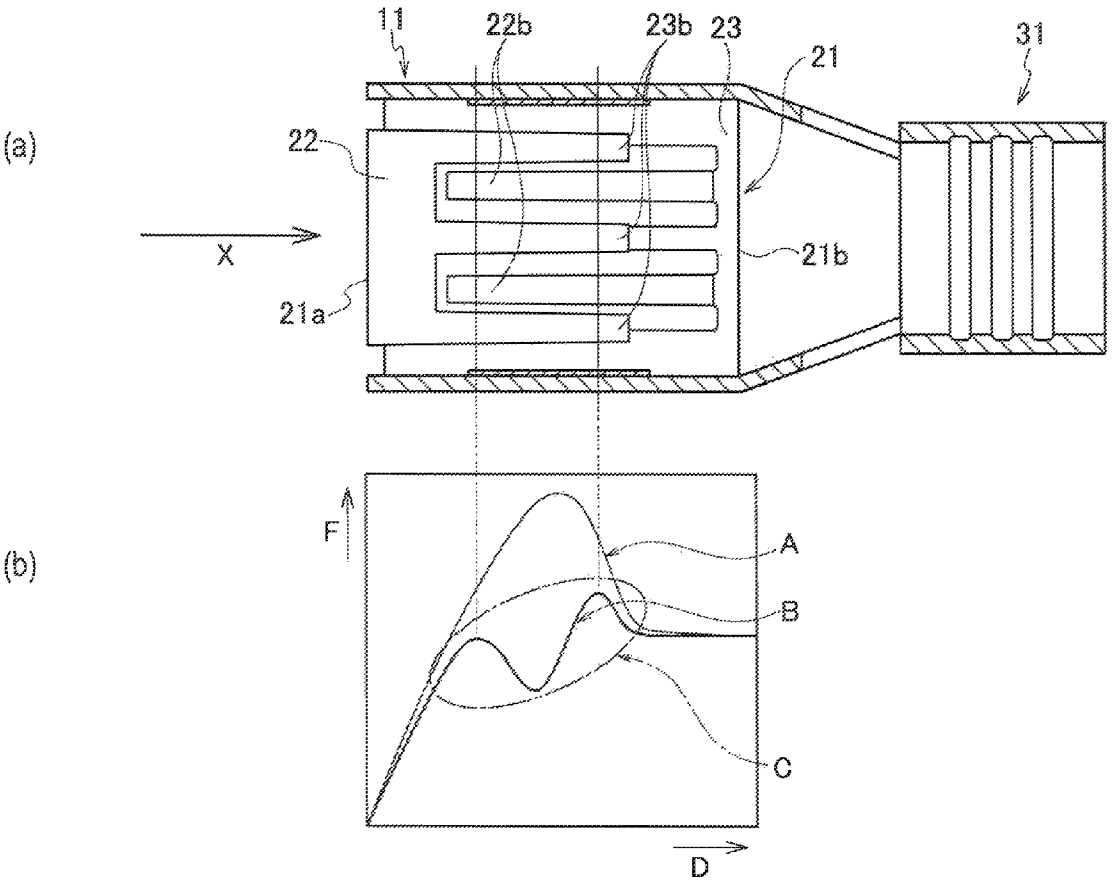
FIGS. 5(*a*) and (*b*) illustrate diagrams for explaining an insertion force with which a male terminal is inserted into the female terminal according to the embodiment of the present invention compared with the related art.

This needs insertion force which is concentrated on and around places at which the contact portions of the respective elastic contact pieces simultaneously get into contact with the male terminal, as shown with a thin line A in FIG. 5(*b*), when the male terminal (unillustrated) is inserted, into the electrical connector 11 of the imaginary female terminal. Incidentally, in FIG. 5(*b*), the axis D of abscissa represents the distance that the male terminal is inserted there, and the axis F of ordinate represents the insertion force with which the male terminal is inserted there, Furthermore, the insertion force needed in this event is extremely large, because the insertion force is equivalent to the total of the insertion resistances from the respective elastic contact pieces due to the resilience.

In contrast to this, in the female terminal 1 of the embodiment of the present invention, the first elastic contact pieces 22 and the second contact pieces 23 are respectively folded back at the first end 21*a* and the second end 21*b* in the top surface 12*a* and the bottom surface 12*b* of the electrical connector II in the insertion direction of the male terminal (unillustrated) (in the arrow-Y direction in FIG. 3), In addition, as shown in FIG. 5(*a*), the contact portions 22*b* of the first elastic contact pieces 22 and the contact portions 23*b* of the second elastic contact pieces 23 are arranged at positions shifted from each other in the insertion direction of the male terminal (unillustrated) (in the arrow-X direction in FIG. 3).

For this reason, when the male terminal (unillustrated) is inserted into the electrical connector 11, the contact portions 22*b* of the first elastic contact pieces 22 start to get into contact with the male terminal earlier than the contact portions 23*b* of the second elastic contact pieces 23. Accordingly, the male terminal stepwise receives the insertion resistances from the first elastic contact pieces 22 due to their resilience and the insertion resistances from the second elastic contact pieces 23 due to their resilience.

As a result, when the male terminal (unillustrated) is inserted into the electrical connector 11 of the female terminal 1 of this embodiment, large insertion force is needed in two locations, as shown in the wide line B in FIG. 5(*b*). One location is a place in and around which the contact portions 22*b* oh the first elastic contact pieces 22 get into contact with the male terminal, and the other location is a place in and around which the contact portions 23*b* of the second elastic contact pieces 23 get into contact with the male terminal.

It should be noted that: the insertion force needed in each location is equivalent to the total of the insertion resistances from the first elastic contact pieces 22 due to their resilience, or equivalent to the total of the insertion resistances from the second elastic contact pieces 23 due to their resilience; and accordingly, the peak value of each insertion force is less than the peak value of the insertion force of the imaginary female terminal. In other words, as shown in the broken line C in FIG. 5(*b*), the peak values of the respective insertion forces are dispersed.

As a result, the female terminal 1 of this embodiment enables the male terminal (unillustrated) to be inserted into the electrical connector 11 with smaller insertion force than the imaginary female terminal. This makes it possible to enhance the workability, and to prevent the male terminal (unillustrated) from being insufficiently fitted into the female terminal 1 due to insufficient insertion of the male terminal into the female terminal 1.

As described, above, the female terminal 1 of the embodiment of the present invention, is the female terminal 1 including: the electrical connector 11 into which the male terminal is to be inserted; and the electrical wire connector (electrical wire crimp part 31) to which the electrical wire electrically connected, to the male terminal inserted in the electrical connector 11 is connected. The electrical, connector 1 is formed integrally with the electrical wire connector (electrical wire crimp part 31). In the electrical connector 11, the elastic contact member 21 capable of getting into contact with the male terminal is formed in at least one surface (the top surface 12*a*, the bottom surface 12*b*) extending in the insertion direction of the male terminal to be inserted there (in the arrow-X direction). The elastic contact member 21 includes: the multiple first elastic contact pieces 22 formed with the space S in between in the widthwise direction (the arrow-Y direction) orthogonal to the insertion direction of the male terminal to be inserted into the electrical connector 11 (the arrow-X direction), each, first elastic contact piece 22 being cantilevered at the first end 21*a* side of the surface (the top surface 12*a*, the bottom surface 12*b*) in the insertion direction (in the arrow-X direction); and the multiple second elastic contact pieces 23, one of which is disposed, in the space S. The first elastic contact pieces 22 and the second elastic contact pieces 23 get into contact with the male terminal inserted in the electrical connector 11.

In the female terminal 1 of the embodiment of the present invention, the first elastic contact pieces 22 and the second elastic contact pieces 23 are formed integrally with the surface (the top surface 12*a*, the bottom surface 12*b*). One of the second elastic contact pieces is disposed in the space S by folding back the second elastic contact pieces at the second end 21*b* of the surface (the top surface 12*a*, the bottom surface 12*b*) in the insertion direction (in the arrow-X direction).

In the female terminal 1 of the embodiment of the present invention, the elastic contact member 21 is formed in each of the two opposed surfaces (the top surface 12*a*, the bottom surface 12*b*) of the electrical connector 11. The male terminal is held between and by the elastic contact members 21 of the respective two surfaces (the top surface 12*a*, the bottom surface 12*b*).

In the female terminal 1 of the embodiment of the present invention, the electrical connector 11 with which the elastic contact members 21 are integrally formed is formed integrally with the electrical wire connector (electrical wire crimp part 31). For this reason, it is possible to reduce the value of the resistance between each elastic contact member 21 and the electrical connector 11, and accordingly to curb the heat generation attributable to the otherwise increase in the value of the resistance.

In the female terminal 1 of the embodiment of the present invention, one of the second elastic contact pieces 23 is disposed in the space S between the first elastic contact pieces 22. For this reason, it is possible to make each first elastic contact piece 22 and each second elastic contact piece 23 long in the insertion direction of the male terminal (unillustrated) (in the arrow-X direction in FIG. 1). Accordingly, it is possible to enhance the elastic force of each first elastic contact piece 22 and the elastic force of each second elastic contact piece 23, and thereby to reduce the insertion force with which the male terminal is inserted into the electrical connector 11.

In sum, it is possible to provide the female terminal 1 which can enhance the elastic force of each of the first and second elastic contact pieces 22, 23 while reducing the value of the resistance between the electrical connector 11 and each of the first and second elastic contact pieces 22, 23.

In the female terminal 1 of the embodiment of the present invention, the first elastic contact pieces 22 and the second elastic contact pieces 23 are formed integrally in each of the top surface 12*a* and the bottom surface 12*b*. In addition, the first elastic contact pieces 22 and the second elastic contact pieces 23 are formed at positions shifted from, each other in a direction, in which the first elastic contact pieces 22 are arranged with the space S in between. With this structure, in the bending process of the first elastic contact pieces 22 and the second elastic contact pieces 23, one of the second elastic contact pieces 23 can be easily disposed in the space S between the first elastic contact pieces 22.

In the female terminal 1 of the embodiment of the present, invention, the male terminal is held between and by the elastic contact members 21 of the respective two surfaces (the top surface 12*a*, the bottom surface 12*b*) of the electrical connector 11. For this reason, it is possible to enhance the reliability of the electrical connection between the female terminal and the male terminal.

In the female terminal 1 of the embodiment of the present invention, the insertion resistance which the male terminal, receives from the elastic contact pieces when the male terminal is inserted into the electrical connector 11 can be dispersed into: the insertion resistance which the male terminal receives from the first elastic contact pieces 22 in contact with the male terminal; and the insertion resistance which the male terminal receives from the second elastic contact pieces 23 in contact with the male terminal, in different timings.

For this reason, the male terminal can be inserted into the electrical connector 11 with the smaller insertion force. This makes it possible to enhance the workability, and to prevent the male terminal from being insufficiently fitted into the female terminal 1 due to insufficient insertion of the male terminal into the female terminal 1.

Although the present invention has been described above by reference to the embodiments, the present invention is not limited to those and the configuration of parts cam be replaced with any configuration having a similar function.

For example, the elastic contact member 21 may be formed in at least one of the top surface 12*a* and the bottom surface 12*b* of the electrical connector 11, although the foregoing descriptions have been provided for the female terminal 1 of the embodiment of the present invention in which the elastic contact member 21 is formed, in each of the top surface 12*a* and the bottom top surface 12*b*.

The number of first elastic contact pieces 22 and the number of second, elastic contact pieces 23 may be changed depending on the necessity, although the foregoing descriptions have been provided for the female terminal 1 of the embodiment of the present invention in which the two first elastic contact pieces 22 and the three second elastic contact pieces 23 are formed in each elastic contact member 21 (see FIG. 3).

What is claimed is:

1. A female terminal comprising:

an electrical connector for a male terminal to be inserted;

an electrical wire connector formed integrally with the electrical connector and connected to an electrical wire to be electrically connected to the male terminal inserted in the electrical connector, wherein the electrical connector comprises an elastic contact member provided in at least one of surfaces of the electrical connector extending in an insertion direction of the male terminal, the elastic contact member being configured to get into contact with the male terminal, wherein the elastic contact member comprises first elastic contact pieces formed with a space in between in a widthwise direction orthogonal to the insertion direction, cantilevered, at one end side of the at least one surface in the insertion direction, and configured to get into contact with the male terminal inserted in the electrical connector, and a second elastic contact piece disposed in the space and configured to get into contact with the male terminal inserted in the electrical connector, and wherein the second elastic contact piece is disposed in the space by being folded back at an other end side of the at least one surface in the insertion direction.

2. The female terminal according to claim 1, wherein the first elastic contact pieces and the second elastic contact piece are formed integrally with the at least one surface.

3. The female terminal according to claim 1, comprising elastic contact members respectively formed in two opposed, surfaces of the electrical connector, wherein the elastic contact members formed in the two surfaces hold the male terminal therebetween.

4. The female terminal according to claim 1, wherein the first elastic contact pieces respectively comprise first contact portions configured to get into contact with the male terminal inserted in the electrical connector, the second elastic contact piece comprises a second contact portion configured to get into contact with the male terminal inserted in the electrical connector, the first contact portions and the second contact portion are arranged at positions shifted from each other in the insertion direction.

* * * * *